US010092121B1

(12) United States Patent
Lopez Rodriguez

(10) Patent No.: US 10,092,121 B1
(45) Date of Patent: Oct. 9, 2018

(54) HAT HANGER

(71) Applicant: Humberto S. Lopez Rodriguez, Renton, WA (US)

(72) Inventor: Humberto S. Lopez Rodriguez, Renton, WA (US)

( * ) Notice: Subject to any disclaimer, the term of this patent is extended or adjusted under 35 U.S.C. 154(b) by 0 days.

(21) Appl. No.: 15/895,902

(22) Filed: Feb. 13, 2018

Related U.S. Application Data

(60) Provisional application No. 62/600,094, filed on Feb. 14, 2017.

(51) Int. Cl.
*A47G 25/10* (2006.01)
*A47F 7/06* (2006.01)

(52) U.S. Cl.
CPC ..... *A47G 25/10* (2013.01); *A47F 7/06* (2013.01)

(58) Field of Classification Search
CPC .... A47G 25/10; A47G 25/32; A47G 25/1457; A47G 25/06; A47F 7/06; A47F 5/0884
USPC ..... 248/304, 339, 301, 309.1, 205.1, 224.8, 248/223.41, 87.01, 85.3; 211/30–32, 113, 211/87.01, 85.3
See application file for complete search history.

(56) References Cited

U.S. PATENT DOCUMENTS 1,700,253 A * 1/1929 Davis ..... A47B 61/003 211/106
1,703,872 A * 3/1929 Engelson ..... A47G 25/06 211/85.3
1,706,887 A * 3/1929 Knostman ..... A47B 61/02 211/85.3
2,060,711 A 11/1936 Wright
2,640,594 A 6/1953 Lesikar
3,178,030 A 4/1965 Huebel
3,677,415 A * 7/1972 Radek ..... A47F 5/0807 248/220.42
3,874,035 A * 4/1975 Schuplin ..... F16B 2/02 248/228.2
4,720,952 A * 1/1988 Fricker ..... E04F 13/0855 52/235
4,733,620 A * 3/1988 Robbins ..... F27D 1/144 110/336
5,094,421 A * 3/1992 Zaccone ..... A47G 1/1653 248/220.1
5,104,083 A * 4/1992 Shannon ..... B60R 7/10 211/105.1

(Continued)

OTHER PUBLICATIONS

Set of 4 Triangle Hooks in African Mahogany With Teak Oil Matte Finish. Modern Isosceles Wall Hooks. Coat, Towel, Robe Hook. Backpack, Bags. Etsy.com, Accessed: Jan. 31, 2018. https://www.etsy.com/listing/548831334/set-of-4-triangle-hooks-in-african.

*Primary Examiner* — Hiwot E Tefera
(74) *Attorney, Agent, or Firm* — DWC Law Firm, P.S.; James Namiki; David Chen

(57) ABSTRACT

A hat hanger with a small form factor is described herein. The hat hanger having a body with a wall mating face configured to mate with a surface of a vertical wall, and a top side face disposed on a top side of the body and being a serrated face with a plurality of saw tooth members. The wall mating face may include a wall mounting component such as a nail for affixing the hat hanger to the vertical wall. The plurality of saw tooth members may include at least one saw tooth member with a greater height than the other saw tooth members of the plurality of saw tooth members.

15 Claims, 10 Drawing Sheets

(56) References Cited

U.S. PATENT DOCUMENTS

| | | | | |
|---|---|---|---|---|
| 5,450,967 | A * | 9/1995 | Mallory | A47F 7/06 211/30 |
| 5,762,206 | A * | 6/1998 | Leichter | A47F 7/06 211/113 |
| 5,950,845 | A * | 9/1999 | Harris | A47G 25/0685 211/100 |
| 6,276,654 | B1 * | 8/2001 | Perkins | E04F 19/00 248/205.1 |
| 6,293,413 | B1 | 9/2001 | Patton | |
| 6,651,945 | B2 | 11/2003 | Rivellino | |
| 8,317,445 | B2 | 11/2012 | Reeder | |
| 8,807,501 | B2 * | 8/2014 | Chung | B25H 3/04 211/70.8 |
| D801,155 | S | 10/2017 | Kuniyoshi | |
| 2005/0109721 | A1 * | 5/2005 | Schneider | A47G 25/1457 211/118 |
| 2006/0283110 | A1 * | 12/2006 | Ferguson | E04F 19/0436 52/211 |
| 2007/0017067 | A1 * | 1/2007 | Coles | F16L 33/035 24/16 PB |
| 2007/0029355 | A1 * | 2/2007 | Dente, Jr. | A47B 61/003 223/85 |
| 2010/0084539 | A1 * | 4/2010 | Popkin | A47G 1/20 248/475.1 |
| 2013/0097945 | A1 * | 4/2013 | Sladojevic | B66C 1/30 52/125.4 |
| 2015/0108304 | A1 | 4/2015 | Larsen Roldan | |

* cited by examiner

HAT HANGER

CROSS REFERENCE TO RELATED APPLICATION(S)

This application claims the benefit of U.S. Provisional Patent Application No. 62/600,094, filed on Feb. 14, 2017, which is incorporated herein by reference in its entirety.

BACKGROUND

1. Field of the Invention

The present invention relates to wall mountable devices, and more particularly, to a hat hanger mountable on a vertical wall.

2. Description of Related Art

In recent years, hats have become a popular form of clothing accessory. Hats come in a variety of forms, shapes, and sizes for a variety of occasions and uses. In some cases, people will wear hats as a fashion statement. In other cases, people will wear particular types of hats for their functionalities in protecting the wearer's eyes, face, and/or neck from excessive sunline or rain. In still other cases, people will wear hats, often in the form of baseball caps, that are adorn with their favorite logos (e.g., the NIKE swoosh) or favorite sporting teams. For at least a small but enthusiastic segment of the population, the collection of hats has become an obsession.

In fact, some hat wearers can be very finicky, if not fanatical, in the care and storage of their hats. For these hat wearers, the big concern is maintaining the proper shapes of their hats. Stored improperly, hats can deform over time from their original or proper shapes.

SUMMARY

Various embodiments of the present disclosure provide for a hat hanger. For these embodiments, the hat hanger may include a body having a height, a length, and a thickness, with a first side face and a second side face disposed opposite of the first face and spaced apart from the first side face by the thickness. The body may also include a wall mating face situated transversely relative to the first side face and second side face, and have a length equal to the height of the body, and a width equal to the thickness of the body, with a first edge of the wall mating face being adjoined to the first side face, and with a second edge of the wall mating face being adjoined to the second side face. The body may also include a top side face situated transversely relative to the first side face and second side face, and being adjoined to the first side face and second side face and having a length equal to the length of the body, and the top side face having a width equal to the thickness of the body, and wherein the top side face is serrated. The body may further include a bottom face situated transversely relative to the first side face and second side face, and may be adjoined to both the wall mating face and the top side face, and may further be adjoined to the first side face and second side face.

In various embodiments, the top side face may be serrated by being configured with a plurality of saw tooth members, wherein at least one of the saw tooth members is greater in height than other saw tooth members of the plurality of saw tooth members. In some cases, the at least one of the saw tooth members that has a height greater than the other saw tooth members of the plurality of saw tooth members has a height that is 20 percent greater than the other saw tooth members of the plurality of saw tooth members. In some cases, the at least one of the saw tooth members that has a height greater than the other saw tooth members of the plurality of saw tooth members is disposed nearest, among the plurality of saw booth members, to an edge of the top side face that adjoins to the bottom face.

In various embodiments, the top side face may be serrated by being configured with a plurality of saw tooth members, and wherein each of the saw tooth members includes a rearward edge face, and wherein each of the rearward edge faces is slanted in an upwardly rearward direction, the wall mating side being rear side of the hat hanger.

In various embodiments, the wall mating face may be a flat surface.

In various embodiments, the wall mating face may further include a wall mounting component. For these embodiments, the wall mounting component is a nail that protrudes less than ¾ inches away from wall mating face. In some cases, the nail may be a wire brad.

In some embodiments, the length of the top side face may be at least 1.5 inches. In some embodiments, the thickness of the body may be less than ⅖ inch. In some embodiments, the top side face may be perpendicular to the wall mating face.

In various embodiments, a wall mounting device is disclosed that includes a body having a height, a length, and a thickness, configured to affix to a vertical wall and to hang a hat therefrom. A first face may be disposed on the body and having a planar surface and a wall mounting component, the wall mounting component at least partially protruding from the first surface and configured to affix the body to the vertical wall, the first face having a width equal to the thickness of the body. A second face disposed on the body and that adjoins the first face and that has a plurality of saw tooth members, where at least one of the saw tooth members is greater in height than other saw tooth members of the plurality of saw tooth members, the second face having a length that equals the length of the body.

In some embodiments, the second face may be an elongated face with a first edge and a second edge opposite from the first edge, and the plurality of saw tooth members are arranged lengthwise along the elongated second face between the first edge and the second edge, the first edge adjoining the first face. For these embodiment, the saw tooth member with the greater height may be located nearest to the second edge among the plurality of saw tooth members. In some cases, the first face is disposed on a rear side of the wall mounting device and the second face is disposed on a top side of the wall mounting device, and wherein each of the saw tooth members includes a rearward edge face, and wherein each of the rearward edge faces is slanted in an upwardly rearward direction.

In some embodiments, the first face is an elongated face having a first edge and a second edge opposite the first edge, the first edge adjoining the second face, and wherein the wall mounting component is a nail that at least partially protrudes from the first face and that is located closer to the first edge than the second edge of the first face. In some embodiments, the second face is perpendicular to the first face.

In various embodiments, a method for hanging a hat from a vertical wall is described, the method includes positioning an interior of a crown of the hat horizontally over a hat hanger having a triangular body with a top side face, the top side face having saw tooth members, each saw tooth member having a rearward edge face that is sloped upwardly rearward toward the vertical wall, and the hat hanger being particularly affixed to the vertical wall such that the top side face faces upwards, the hat further having a visor attached to a front portion of the crown; moving the hat towards the vertical wall in a way such that interior of the crown covers the hat hanger; and hanging the hat from the hat hanger such that the visor is resting on top of the hat hanger when the hat is hanging from the hat hanger and that at least one of the saw tooth members will hook an inside lining of the hat if the hat is laterally or downwardly pulled or falls away from the hat hanger.

DETAILED DESCRIPTION

Figure 1A:
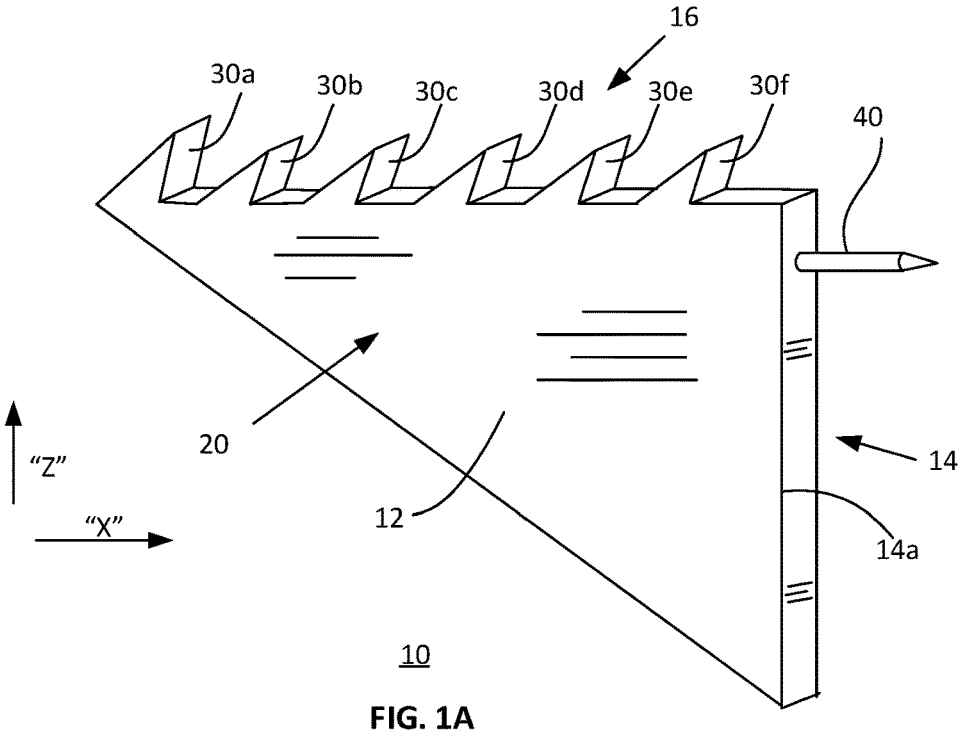
FIG. 1A is a perspective left side view of an embodiment of a hat hanger of the present disclosure.

In the present description, certain specific details are set forth in order to provide a thorough understanding of various embodiments of the disclosure. However, upon reviewing this disclosure one skilled in the art will understand that the various embodiments disclosed herein may be practiced without many of these details. In other instances, some well-known structures and materials of construction have not been described in detail to avoid unnecessarily obscuring the descriptions of the embodiments of the disclosure.

In the present disclosure, to the extent the terms "about," "approximately," and "substantially" are used, they mean±20% of the indicated range, value, or structure, unless otherwise indicated. In the present description, the terms "a" and "an" as used herein refer to "one or more" of the enumerated components. The use of the alternative (e.g., "or") should be understood to mean either one, both, or any combination thereof of the alternatives. As used herein, the terms "include" and "comprise" are used synonymously, the terms and variants of which are intended to be construed as non-limiting. The definitions in this paragraph are intended to apply throughout this disclosure unless otherwise expressly stated.

According to various embodiments of the present disclosure, a hat hanger with a small profile is disclosed that is configured to be mounted to a surface of a vertical wall and for hanging a hat therefrom. In some cases, a user may be able to display and store a hat by hanging the hat on the hat hanger affixed to a wall without fear of the hat being warped or deformed. In various embodiments, the hat hanger, which may also be referred to herein as a wall mounting device, may include a body that is configured to be affixed to a vertical wall. The body having a particular height, length, and thickness and includes at least a first face and a second face. The first face may have a planar surface, and a wall mounting component (e.g., a nail such as a wire brad) that at least partially protrudes from the first surface and that is configured to affix the body to the vertical wall, the first face having a width equal to the thickness of the body. The second face may adjoin the first face and that has a plurality of saw tooth members, where at least one of the saw tooth members is greater in height than other saw tooth members of the plurality of saw tooth members, the second face being an elongated face having a length that equals the length of the body.

In some embodiments, the hat hanger may include a body that may have a triangular shape and that may be defined by a particular height, length and thickness. For these embodiments, the body may have a first side face and a second side face disposed opposite of the first face and spaced apart from the first side face by the thickness of the body. The body may also include a wall mating face, a top side face, and a bottom face.

The wall mating face may be situated transversely (e.g., crosswise) relative to the first side face and second side face, and may have a length equal to the height of the body, and a width equal to the thickness of the body, with a first edge of the wall mating face being adjoined to the first side face, and with a second edge of the wall mating face being adjoined to the second side face. The top side face may be situated transversely relative to the first side face and second side face, and may be adjoined to the first side face and second side face. The top side face may have a length equal to the length of the body and may have a width equal to the thickness of the body. In various embodiments, the top side face may be serrated by being configured with a plurality of saw tooth members. The bottom face may be situated transversely relative to the first side face and the second side face, and may be adjoined to both the wall mating face and the top side face. The bottom face may also be adjoined to the first side face and the second side face. In some alternative embodiments, the body of the hat hanger may not have a triangular shape. but instead, may have other shape types such as a rectangular, pentagonal, and so forth.

Figure 1B:
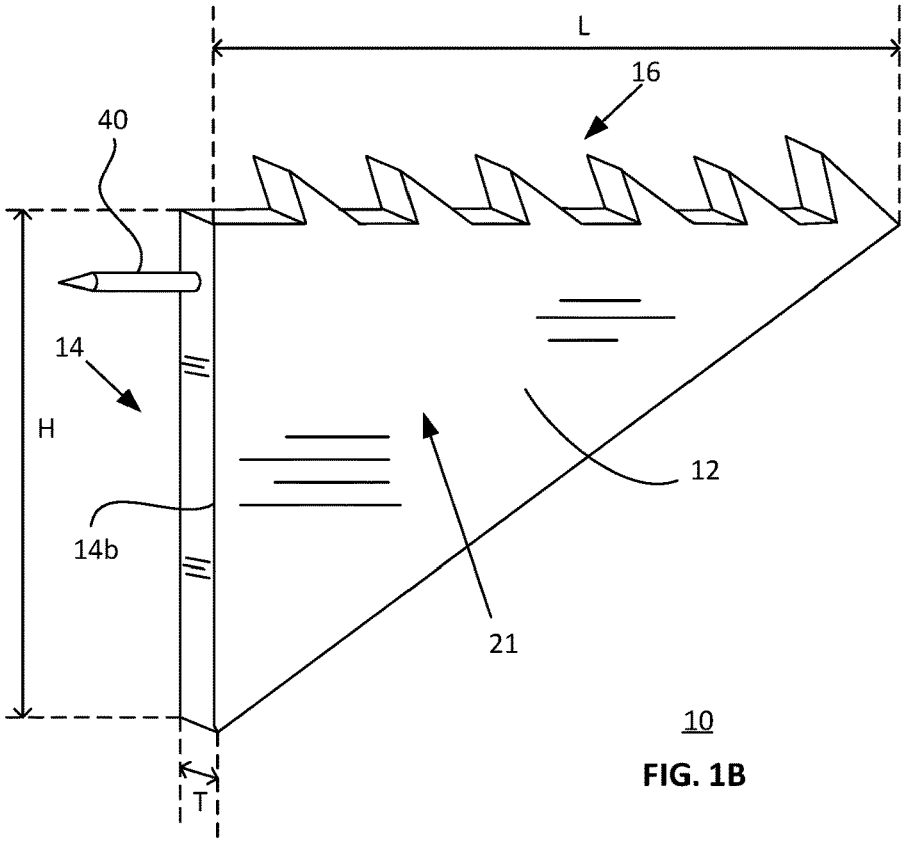
FIG. 1B is a perspective right side view of the hat hanger of FIG. 1A.

Turning to FIGS. 1A and 1B, which are perspective views from opposite sides of a hat hanger 10 according to various embodiments. As illustrated, the hat hanger 10 having a body 12 with a triangular shape and a relatively thin profile. The hat hanger 10 having five faces (e.g., five sides) including a first side face 20, a second side face 21, a wall mating face 14, a top side face 16, and a bottom face 18 (see FIG. 3). The body 12 may be made from a variety of materials including, for example, metal, metal alloy, plastic and/or wood. As illustrated in FIG. 1B, the body 12 has a particular height ("H"), length ("L"), and thickness ("T"). The first side face 20 and the second side face 21 are disposed on opposite sides of the body 12 and spaced apart by the thickness T of the body 12. In some embodiments, the first side face 20 and the second side face 21 may each be planar surfaces. In other alternative embodiments, however, the first side face 20 and the second side face 21 may not be planar surfaces (e.g., concave or convex surfaces, or multi-level surfaces).

Note that in the following description, words such as "front," "forward," "rear," "rearward,", "top," "bottom" and the like, may be used in reference to the hat hanger 10 and to the locations and orientations of various components of the hat hanger 10. Of course, these words may not have any relevance unless there is some point or points of reference. Accordingly, in FIG. 1A, arrow "X" points toward the rear of the hat hanger, while arrow Z points in the upward direction. Thus, the opposite directions to arrows X and Z would be in the forward and downward directions, respectively.

The wall mating face 14 is designed to abut against a vertical wall when the hat hanger 10 is affixed to the surface of the wall. In various embodiments, the wall mating face 14 may comprise of a flat surface and may be situated transversely (e.g., crosswise) relative to the first side face 20 and the second side face 21. In various embodiments, the wall mating face 14 may be an elongated face having a length equal to the height H of the body 12, and a width equal to the thickness T of the body 12. As illustrated in FIGS. 1A and 1B, the wall mating face 14 having a rectangular shape with four sides or edges including a first edge 14*a* that is adjoined to the first side face 20 and a second edge 14*b* that is adjoined to the second side face 21.

In various embodiments, the wall mating face 14 may include a wall mounting component 40 that at least partially protrudes from the wall mating face 14. In some embodiments, the wall mounting component 40 may be a nail such as a wire brad. In other embodiments, however, other types of wall mounting components may be employed such as a screw or a serrated nail that is not easily removable from a wall once inserted into the wall. In some embodiments where the wall mounting component 40 is a nail, the nail may not protrude more than ¾ inches (see distance "D" in FIG. 2) from the wall mating face 14. For example, in one embodiment, the nail protrudes approximately ¼ inch from the wall mating face 14. To affix the hat hanger 10 to, for example, a dry wall, the body 12 with the wall mating face 14 facing the wall surface may be pushed against the wall surface so that the nail penetrates the wall.

Figure 4A:
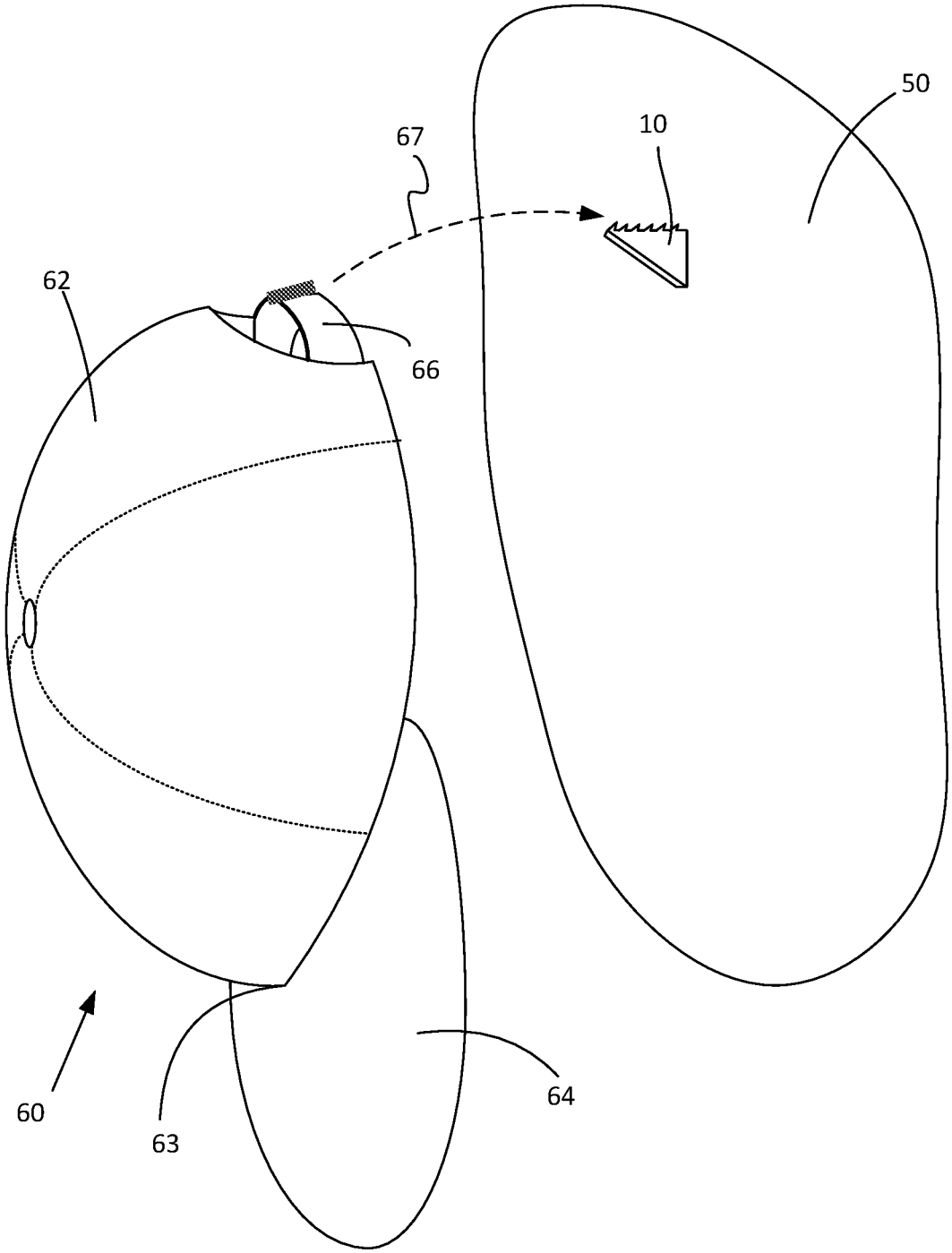
FIG. 4A illustrates an example snapback hat being horizontally positioned over the hat hanger of FIG. 1A.
Figure 4B:
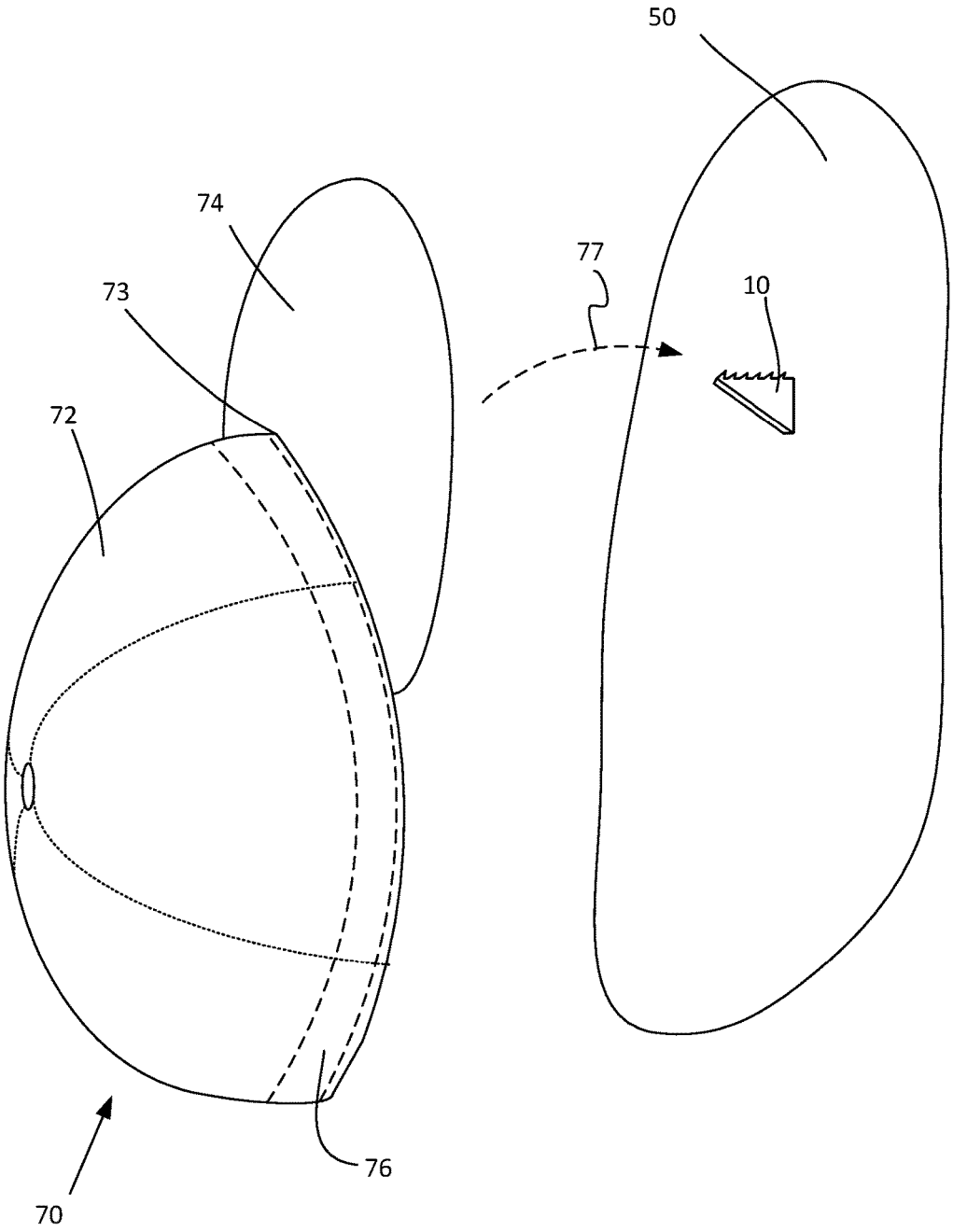
FIG. 4B illustrated an example fitted cap being horizontally positioned over the hat hanger of FIG. 1A.
Figure 5:
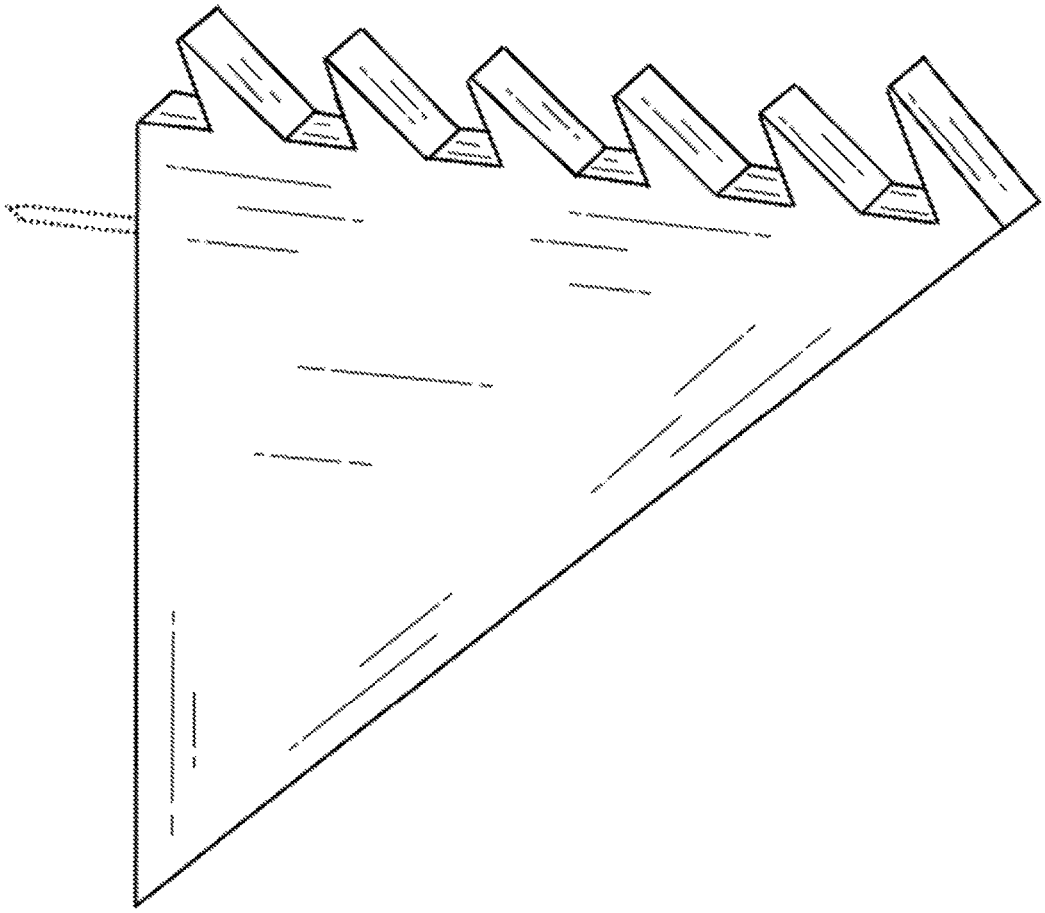
FIG. 5 is a perspective of an embodiment of the hat hanger of the present disclosure.
Figure 6:
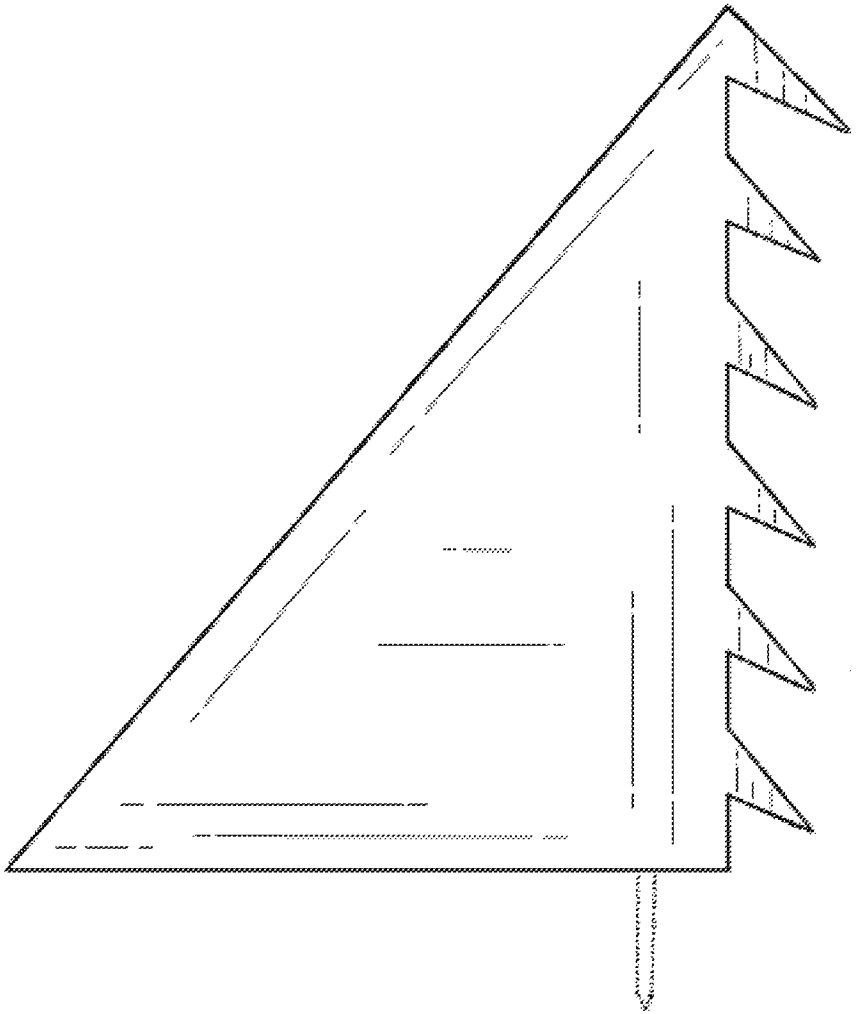
FIG. 6 is a left side elevation view thereof.
Figure 7:
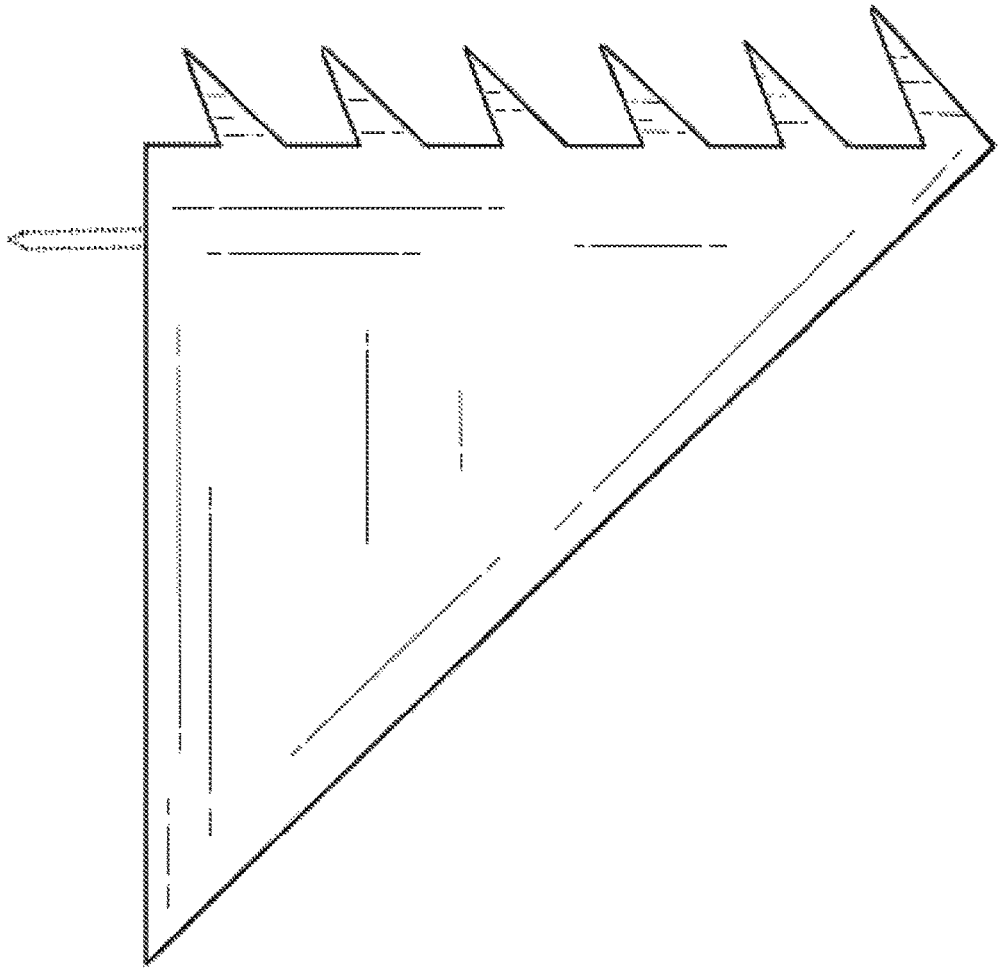
FIG. 7 is a right side elevation view thereof.
Figure 8:
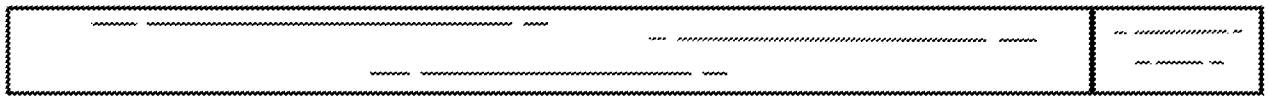
FIG. 8 is a front elevation view thereof.
Figure 9:
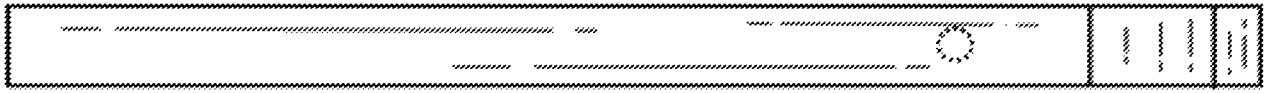
FIG. 9 is a rear elevation view thereof.
Figure 10:
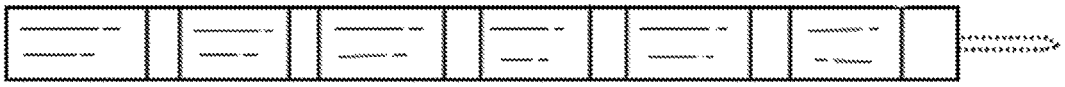
FIG. 10 is a top plan view thereof.
Figure 11:
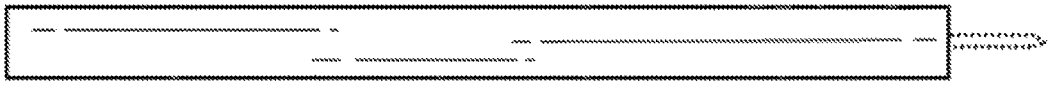
FIG. 11 is a bottom plan view thereof.

In various embodiments, the top side face 16 may be a serrated face that is configured to snag or hook, for example, the inside lining or a strap of a hat as will be further described herein with reference to FIGS. 4A and 4B. As illustrated in FIGS. 1A and 1B, the top side face 16 is situated transversely relative to the first side face 20 and second side face 21. In the illustrated embodiment, the top side face 16 is adjoined to the first side face 20 and the second side face 21 and has a length equal to the length L of the body 12. In some embodiments, the top side face 16 may have an elongated shape having a length L of at least 1.5 inches. For example, in one embodiment, the length L is approximately two inches. In some embodiments, the length of the hat hanger 10 may depend on the type and size of the hat to be hung from the hat hanger 10. The top side face 16 may have a width equal to the thickness T of the body 12. In some embodiments, thickness T may be less than ⅖ inch. For example, in one embodiment, thickness T is approximately ¼ inch.

With respect to height H, the height H should be of sufficient length such that the hat hanger 10 cannot be easily pulled out of a wall that it is affixed to. That is, when the hat hanger 10 is affixed to a wall, the wall mounting component 40 (e.g., a nail) acts as an anchor or a hinge. Thus, the length of the wall mating face 14 acts as a leverage to prevent the hat hanger 10 from being pulled away from the wall when downward pressure is applied to the hat hanger 10. To avoid such a situation, the height H should be of sufficient length to provide sufficient leverage for preventing downward pressures from causing the hat hanger 10 from being pulled out of the wall. For example, in one embodiment, height H is approximately 1¾ inches long.

The serrated top side face 16 may include a plurality of saw tooth members 30*a*, 30*b*, 30*c*, 30*d*, 30*e*, and 30*f*. In various embodiments, the plurality of saw tooth members 30*a*-30*f* may be arranged lengthwise along the elongated top side face 16 from one edge 16*a* to an opposite edge 16*b* (see FIG. 2). In various embodiments, saw tooth member 30*a* has a height greater than the other saw tooth members 30*b*-30*f*. For example, and referring to FIG. 2 which is an elevation view of the hat hanger 10, the saw tooth member 30*a* may have a height "A," while saw tooth members 30*b*-30*f* may have a height B that is shorter than height A of the saw tooth member 30*a*. In some embodiments, height A may be at least 20 percent greater than height B. In various embodiments, the top side face 16 is substantially perpendicular to the wall mating face 14. In alternative embodiments, however, the top side face 16 may not be perpendicular to the wall mating face 14.

Figure 2:
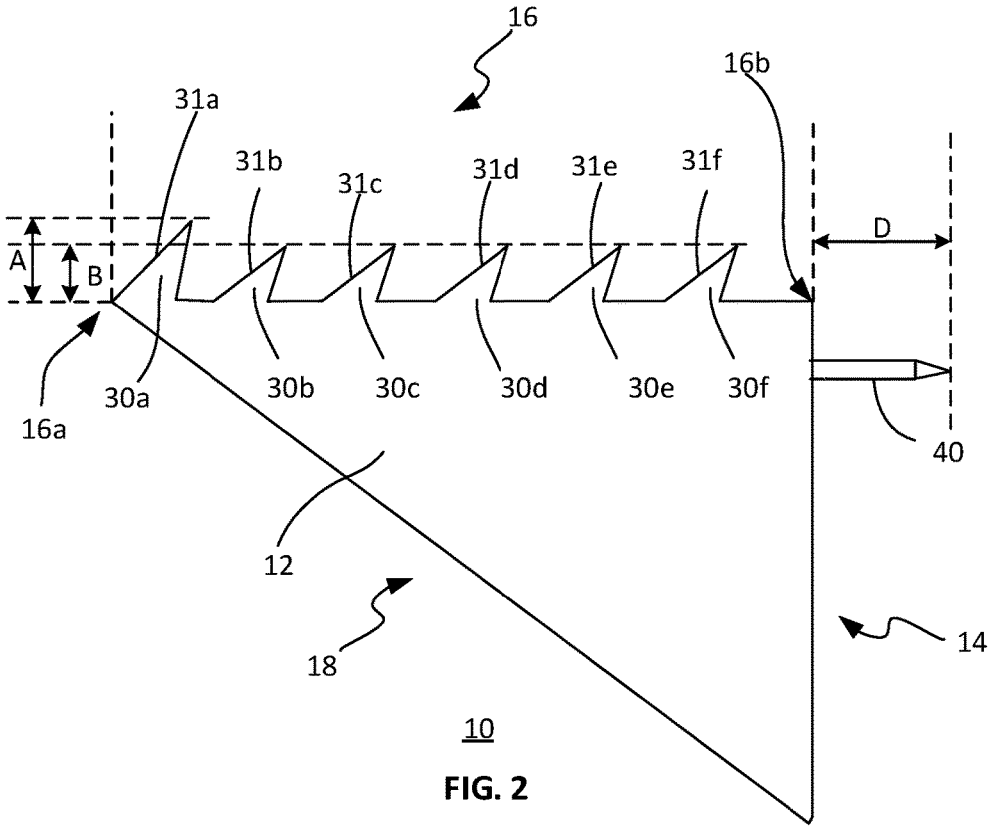
FIG. 2 is a left elevation view of the hat hanger of FIG. 1A.

As illustrated in FIG. 2, saw tooth member 30*a* (e.g., tallest saw tooth member) may be located nearest to edge 16*a* of the top side face 16 among the plurality of saw tooth members 30*a*-30*f*. In this case, the saw tooth member 30*a* is disposed at or adjacent to the edge 16*a*. In various embodiments, each of the saw tooth members 30*a*-30*f* includes a rearward edge face 31*a*, 31*b*, 31*c*, 31*d*, 31*e*, and 31*f*, where each of the rearward edge faces 31*a*, 31*b*, 31*c*, 31*d*, 31*e*, and 31*f* is slanted in an upwardly rearward direction and that may be flat.

Figure 3:
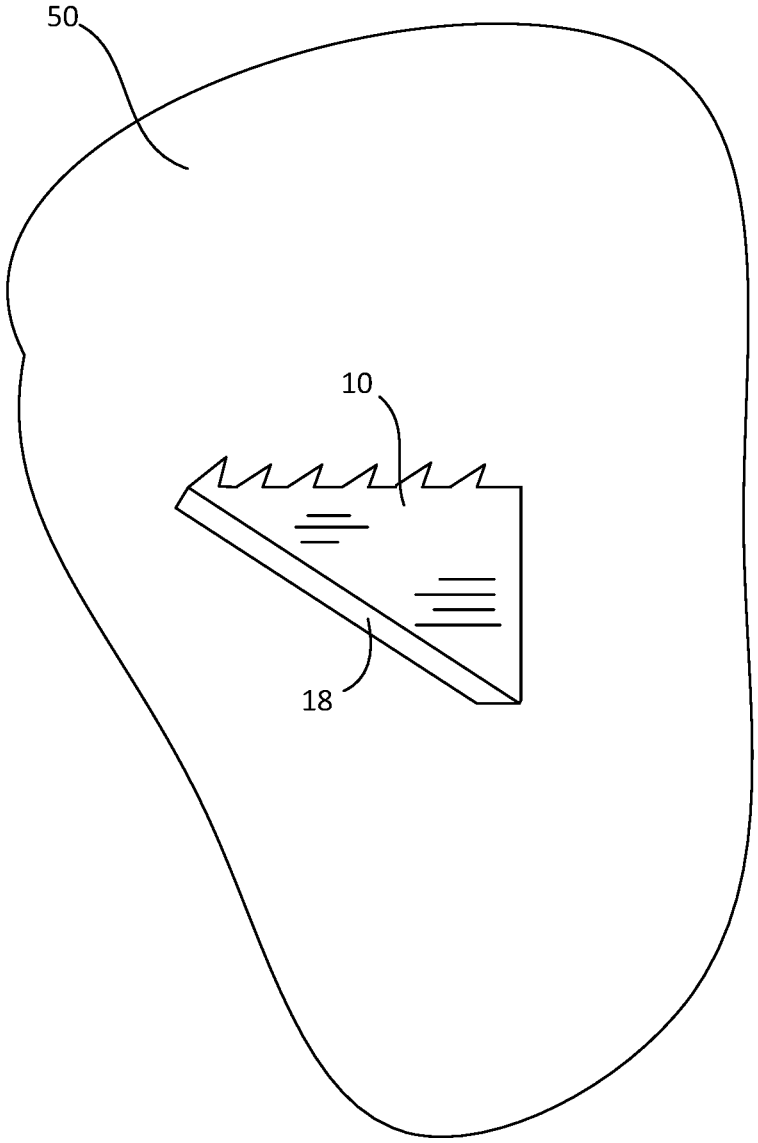
FIG. 3 illustrates the hat hanger of FIG. 1A affixed to a vertical wall.

As illustrated in FIG. 3, which illustrates the hat hanger 10 affixed to a vertical wall 50 (e.g., a drywall), the hat hanger 10 includes a bottom face 18 that is situated transversely (e.g., crosswise) relative to the first side face 20 and second side face 21 of the body 12 and is adjoined to the first side face 20 and the second side face 21. The bottom face 18 may be adjoined to both the wall mating face 14 and the top side face 16, FIG. 4A illustrates a hat 60 being positioned horizontally over a hat hanger 10, which is affixed to a vertical wall 50, in order to hang the hat 60 from the hat hanger 10. The hat 60, which in this case is a particular type of baseball cap commonly called a "snapback hat," includes a crown 62, a visor 64 attached to the front portion 63 of the crown 62, and an adjustable snap closure 66 at the backside of the crown 62. The adjustable snap closure 66 being a strap for tightening or loosening the crown to accommodate different sized heads.

To hang the hat 60 from the hat hanger 10, the interior of the crown 62 may be horizontally positioned over the hat hanger 10 such that when the hat 60 is horizontally moved or repositioned towards the wall 50 the snap closure 66 of the hat 60 will be above the hat hanger 10. Note that in the illustrated example of FIG. 4A, the hat 60 is being raised up from below the hat hanger 10 to position the interior of the crown 62 horizontally over the hat hanger 10 as depicted by broken arrow 67. When the snap closure 66 of the hat 60 is hung on the top side face 16 of the hat hanger 10, the plurality of saw tooth members 30*a*-30*f* may ensure that the snap closure 66 does not slip off the hat hanger 10 by snagging or hooking, for example, the snap closure 66. If the shorter saw tooth members 30*b*-30*f* are unable to hook or snag the snap closure 66, then the taller saw tooth member 30*a* is configured to be able to hook or snag the snap closure 66 to ensure that the hat 60 does not slip off the hat hanger 10. Thus, the taller saw tooth member 30*a* may act as the saw tooth member that has the last chance to snag or hook the snap closure 66 among the plurality of saw tooth members 30*a*030*f*.

Note that in FIG. 4A, the hat 60 is particularly positioned relative to the hat hanger 10 such that when hat 60 is hung from the hat hanger 10 the visor 64 will be hanging below the hat hanger 10. In some cases, however, it may be preferable to position the visor 64 above the hat hanger 10 when the hat 60 is being hung from the hat hanger 10 as illustrated in FIG. 4B. This is because when the hat 60 is hung from the hat hanger 10 and the visor 64 is positioned below the hat hanger 10, the weight of the visor 645 tends to pull the crown 62 down potentially causing the crown 62 to warp. By positioning the visor 64 above the hat hanger 10, the hat hanger 10 can support the weight of the visor 64 preventing the crown 62 from deforming.

FIG. 4B illustrates a hat 70 being positioned horizontally over a hat hanger 10 that is affixed to a vertical wall 50 in order to hang the hat 70 from the hat hanger 10. The hat 70, which is a particular type of baseball cap commonly called a "fitted cap," includes a crown 72, and a visor 74 attached to the front portion 73 of the crown 72. Many types of hats, including hat 70, have an inside lining 76 (FIG. 4B shows the outline of the inside lining 76) that completely or partially encircles the interior of the crown 72. In some cases, the inside lining 76 may be a sweatband.

To hang the hat 70 from the hat hanger 10, the interior of the crown 72 may be horizontally positioned over the hat hanger 10 such that when the hat 70 is horizontally moved or repositioned towards the wall 50, the visor 74 will end up being above or on top of the hat hanger 10 as illustrated by broken arrow 77. When the hat 70 is moved towards the vertical wall 50 to hang the hat 70 from the hat hanger 74, the interior of the crown 72 may cover the hat hanger 10 in such a way that the visor 74 will be positioned above the hat hanger 74. Once the hat 70 is hung from the hat hanger 74, the visor 74 may rest on top of the hat hanger 74. As a result, the weight of the visor 74 will be substantially supported by the hat hanger 74, preventing the crown 72 from deforming. When the hat 70 is hung from the hat hanger 10, the plurality of saw tooth members 30*a*-30*f* may ensure that the hat 70 does not slip off the hat hanger 10 by snagging or hooking, for example, the inside lining 76. That is, when the hat 70 is properly hung from the hat hanger 10, the saw tooth members 30*a*-30*f* are configured such that at least one of the saw tooth members 30*a*-30*f* will snag or hook the inside ling 76 when the hat 70 is horizontally or downwardly begins being pulled or falling (e.g., moving) away from the hat hanger 10. If the shorter saw tooth members 30*b*-30*f* are unable to hook or snag the inside lining 76, then the taller saw tooth member 30*a* is configured to be able to hook or snag the inside lining 76 to ensure that the hat 60 does not slip off the hat hanger 10.

The various embodiments described herein, are presented as non-limiting example embodiments of the present disclosure, unless otherwise expressly indicated. After reviewing the present disclosure, an individual of ordinary skill in the art will immediately appreciate that some details and features can be added, removed and/or changed without deviating from the spirit of the disclosure. Reference throughout this specification to "various embodiments," "one embodiment," "an embodiment," "additional embodiment(s)", "alternative embodiments," or "some embodiments," means that a particular feature, structure or characteristic described in connection with the embodiment(s) is included in at least one or some embodiment(s), but not necessarily all embodiments, such that the references do not necessarily refer to the same embodiment (s). Furthermore, the particular features, structures, or characteristics may be combined in any suitable manner in one or more embodiments. These and other changes can be made to the embodiments in light of the above-detailed description. In general, in the following claims, the terms used should not be construed to limit the claims to the specific embodiments disclosed in the specification, but should be construed to include all possible embodiments along with the full scope of equivalents to which such claims are entitled.

What is claimed is:

1. A hat hanger comprising:

a body having a height, a length, and a thickness, with a first side face and a second side face disposed opposite of the first side face and spaced apart from the first side face by the thickness;

a wall mating face situated transversely relative to the first side face and second side face, and having a length equal to the height of the body, and a width equal to the thickness of the body, with a first edge of the wall mating face being adjoined to the first side face, and with a second edge of the wall mating face being adjoined to the second side face;

a top side face situated transversely relative to the first side face and second side face, being adjoined to the first side face and second side face and having a length equal to the length of the body, and having a width equal to the thickness of the body, and wherein the top side face is serrated;

a bottom face situated transversely relative to the first side face and second side face, and being adjoined to both the wall mating face and the top side face, and further being adjoined to the first side face and second side face;

wherein the top side face is serrated by being configured with a plurality of saw tooth members, wherein at least one of the saw tooth members is greater in height than other saw tooth members of the plurality of saw tooth members; and wherein the at least one of the saw tooth members that has a height greater than the other saw tooth members of the plurality of saw tooth members is disposed nearest, among the plurality of saw tooth members, to an edge of the top side face that adjoins to the bottom face.

2. The hat hanger of claim 1, wherein the at least one of the saw tooth members that has a height greater than the other saw tooth members of the plurality of saw tooth members has a height that is 20 percent greater than the other saw tooth members of the plurality of saw tooth members.

3. The hat hanger of claim 1, wherein each of the saw tooth members including the at least one saw tooth member that has a height greater than the other saw tooth members of the plurality of saw tooth member includes a rearward edge face, and wherein each of the rearward edge faces is flat and slanted in an upwardly rearward direction, the wall mating face being rear side of the hat hanger.

4. The hat hanger of claim 1, wherein the wall mating face is a flat surface.

5. The hat hanger of claim 1, wherein the wall mating face further includes a wall mounting component.

6. The hat hanger device of claim 5, wherein the wall mounting component is a nail that protrudes less than ¾ inches away from wall mating face.

7. The hat hanger device of claim 6, wherein the nail is a wire brad.

8. The hat hanger of claim 1, wherein the length of the top side face is at least 1.5 inches.

9. The hat hanger device of claim 1, wherein the thickness of the body is less than ⅖ inch.

10. The hat hanger device of claim 1, wherein the top side face is perpendicular to the wall mating face.

11. A wall mounting device, comprising:

a body having a height, a length, and a thickness, configured to affix to a vertical wall and to hang a hat therefrom;

a first face disposed on the body and having a planar surface and a wall mounting component, the wall mounting component at least partially protruding from the first face and configured to affix the body to the vertical wall, the first face having a width equal to the thickness of the body;

a second face disposed on the body and that adjoins the first face and that has a plurality of saw tooth members, where at least one of the saw tooth members is greater in height than other saw tooth members of the plurality of saw tooth members, the second face having a length that equals the length of the body;

wherein the second face is an elongated face with a first edge and a second edge opposite from the first edge, and the plurality of saw tooth members are arranged lengthwise along the elongated second face between the first edge and the second edge, the first edge adjoining the first face; and wherein the saw tooth member with the greater height is located nearest to the second edge among the plurality of saw tooth members.

12. The wall mounting device of claim 11, wherein the first face is disposed on a rear side of the wall mounting device and the second face is disposed on a top side of the wall mounting device, and wherein each of the saw tooth members includes a rearward edge face, and wherein each of the rearward edge faces is flat and slanted in an upwardly rearward direction.

13. The wall mounting device of claim 11, wherein the first face is an elongated face having a first edge and a second edge opposite the first edge, the first edge adjoining the second face, and wherein the wall mounting component is a nail that at least partially protrudes from the first face and that is located closer to the first edge than the second edge of the first face.

14. The wall mounting device of claim 11, wherein the second face is perpendicular to the first face.

15. A method for hanging a hat from a vertical wall, the method comprising:

positioning an interior of a crown of the hat horizontally over a hat hanger having a triangular body with a top side face, the top side face having saw tooth members, each saw tooth member having a rearward edge face that is sloped upwardly rearward toward the vertical wall, and the hat hanger being particularly affixed to the vertical wall such that the top side face faces upwards, the hat further having a visor attached to a front portion of the crown;

moving the hat towards the vertical wall in a way such that interior of the crown covers the hat hanger;

hanging the hat from the hat hanger such that the visor is resting on top of the hat hanger when the hat is hanging from the hat hanger and that at least one of the saw tooth members will hook an inside lining of the hat if the hat is laterally or downwardly begins being pulled or falling away from the hat hanger;

wherein at least one of the saw tooth members is greater in height than other saw tooth members of the top side face; and wherein the at least one of the saw tooth members that has a height greater than the other saw tooth members is disposed furthest, among the saw tooth members of the top side face, from the vertical wall.

* * * * *